US006325770B1

(12) United States Patent
Beny et al.

(10) Patent No.: US 6,325,770 B1
(45) Date of Patent: Dec. 4, 2001

(54) DEVICE FOR PRODUCING CONTINUOUS PASSIVE MOTION

(75) Inventors: Laurent Beny, Cliron; René Griesmar, Tournes, both of (FR)

(73) Assignee: Smith & Nephew Kinetec SA, Tournes (FR)

( * ) Notice: Subject to any disclaimer, the term of this patent is extended or adjusted under 35 U.S.C. 154(b) by 0 days.

(21) Appl. No.: 09/380,393

(22) PCT Filed: Feb. 27, 1998

(86) PCT No.: PCT/FR98/00396

§ 371 Date: Jan. 21, 2000

§ 102(e) Date: Jan. 21, 2000

(87) PCT Pub. No.: WO98/37850

PCT Pub. Date: Sep. 3, 1998

(30) Foreign Application Priority Data

Feb. 27, 1997 (FR) ..... 97 02334

(51) Int. Cl.[7] ..... A61H 1/00
(52) U.S. Cl. ..... 601/34; 601/33
(58) Field of Search ..... 601/5, 23, 24, 601/26, 33, 34, 35, 90, 93, 98, 101

(56) References Cited

U.S. PATENT DOCUMENTS

| | | | | |
|---|---|---|---|---|
| 2,832,334 | | 4/1958 | Whitelaw . | |
| 3,683,897 | | 8/1972 | Shield et al. . | |
| 3,976,057 | | 8/1976 | Barclay . | |
| 4,214,577 | | 7/1980 | Hoy . | |
| 4,825,852 | * | 5/1989 | Genovese et al. | 601/34 |
| 5,211,161 | | 5/1993 | Stef . | |
| 5,228,432 | * | 7/1993 | Kaiser et al. | 601/34 |
| 5,239,987 | * | 8/1993 | Kaiser et al. | 601/34 |
| 5,280,783 | * | 1/1994 | Focht et al. | 601/34 |
| 5,399,147 | * | 3/1995 | Kaiser | 601/34 |
| 5,529,573 | * | 6/1996 | Kelly et al. | 601/34 |

FOREIGN PATENT DOCUMENTS

| | | |
|---|---|---|
| 0 230 218 A1 | 7/1987 | (DE) . |
| 0 590 973 A2 | 4/1994 | (EP) . |
| 1243-725 A1 | 1/1985 | (SU) . |
| WO 94/15571 | 7/1994 | (WO) . |

* cited by examiner

*Primary Examiner*—Michael A. Brown
*Assistant Examiner*—Benjamin K. Koo
(74) *Attorney, Agent, or Firm*—Fulbright & Jaworski L.L.P.

(57) ABSTRACT

A device for producing a continuous passive motion machine for the bending and stretching of the jointed limb of a person, according to a predetermined motion cycle. The device includes a driving element capable of moving to-and-fro along a linear path defined as a base element and an upper and lower element supporting a jointed limb, linked for pivoting about an axis x—x that is substantially transverse relative to said path. A linking element connects the upper element to the driving element. The linking element is mounted so as to pivot in relation to both said upper support element and the driving element about axes that extend substantially transverse relative to the path. The lower element supporting the limb is adapted to be retained in sliding engagement against the linking element.

7 Claims, 2 Drawing Sheets

DEVICE FOR PRODUCING CONTINUOUS PASSIVE MOTION

BACKGROUND OF THE INVENTION

1. Field of the Invention

This invention pertains to a device intended to produce a continuous passive motion that is generally referred to as "CPM", which corresponds to the abbreviation of the English expression "Continuous Passive Motion". Such device is frequently used in the physical and functional rehabilitation of the jointed limbs of a patient. This invention is specifically intended to be used as a device that will allow the lower limb of a person to undergo forced bending-stretching motions.

2. Description of the Related Art

This invention pertains to a device intended to produce a continuous passive motion that is generally referred to as "CPM", which corresponds to the abbreviation of the English expression "Continuous Passive Motion". Such device is frequently used in the physical and functional rehabilitation of the jointed limbs of a patient. This invention is specifically intended to be used as a device that will allow the lower limb of a person to undergo forced bending-stretching motions.

A treatment that is often prescribed for the rehabilitation of limbs, in particular the lower limbs, is the rehabilitating mobilization that consists in subjecting the limb to be rehabilitated to forced bending-stretching exercises according to programs that involve mobilization cycles where the frequency, amplitude and speed can be adjusted. However, a patient may not have the required muscular power or capacity to actively control the alternating bending and stretching of a limb. That is why a rehabilitation method is recommended which involves the passive motion of the limb to be rehabilitated by applying external forces to the limb.

Such passive motion can be applied manually by experienced therapists, but this method requires a true and comprehensive knowledge of human anatomy and involves a significant physical effort. Therefore, such passive motion is frequently applied to the limb to be rehabilitated through a device, generally referred to as a splint, capable of imposing adjusted bending-stretching cycles on the limb to be rehabilitated.

The previously described method proposed a relatively high number of technical solutions to build such devices.

One of the disadvantages of the CPM devices used in accordance with the previously described method is the fact that they are generally bulky, while a full bending-stretching motion is required for the splint of a lower limb that consists of long jointed segments. Such bulkiness can hinder the implementation, which involves the placement of such device directly on the mattress of the patient's bed.

Another disadvantage is due to the fact that such devices arc generally driven by one or several direct drive units, which requires a motor output that is sufficient to maintain a mechanization that is always adequate for the mass of the limb to be moved. Consequently, this requirement calls for motors that burden the device and increase its bulkiness.

Another disadvantage concerns the degree of difficulty, or even impossibility, encountered when adjustments are made to match the proximal joint axis of the device with the coxofemoral joint of the limb to be rehabilitated, which applies to all anatomical configurations and all limb lengths that may be encountered. However, it is recognized that such requirement conditions the application of the passive rehabilitating motions imposed on the limb to be rehabilitated, without any induced residual physical stress.

The purpose of the invention is to eliminate the above-mentioned disadvantages by proposing a CPM device which must also be readily adaptable to either a right or left limb, offering the same anatomical adjustability.

BRIEF SUMMARY OF THE INVENTION

According to this invention, the device designed to provide a continuous passive motion for the bending and stretching of the jointed limb of a person, according to a predetermined motion cycle, is characterized by the fact that it consists of:

- a driving element capable of moving to-and-fro along a linear path defined as the base element;
- upper and lower elements supporting the limb, linked for pivoting about an axis x–x' that is substantially transverse relative to said path;
- and a linking element connecting said upper element to said driving element, said linking element being connected for pivoting, relative to both said upper support element and said driving element about axes extending substantially transverse relative to said path, and said lower element supporting the limb being adapted to be retained in a sliding engagement against said linking element.

BRIEF DESCRIPTION OF THE DRAWINGS

Other advantages of this invention will emerge from the description given below in reference to the attached drawings, where.

DETAILED DESCRIPTION OF THE INVENTION

Figure 1:
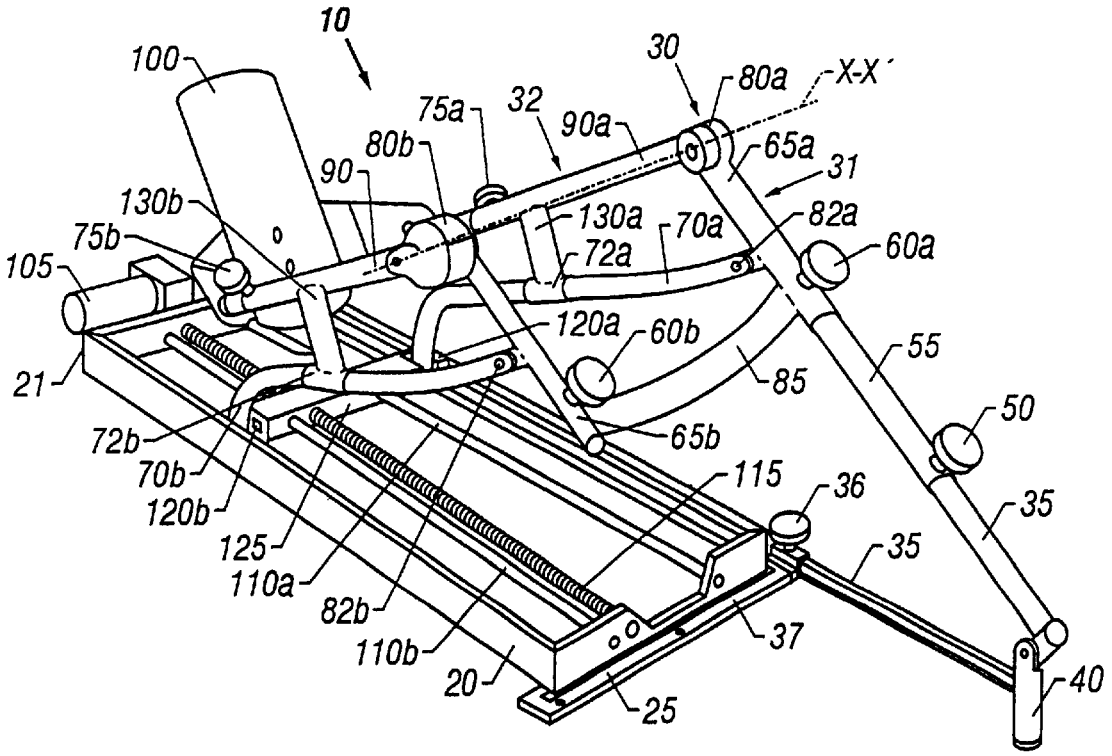
FIG. 1 is a perspective projection of the device for producing a continuous passive motion (CPM) according to this invention.
Figure 2:
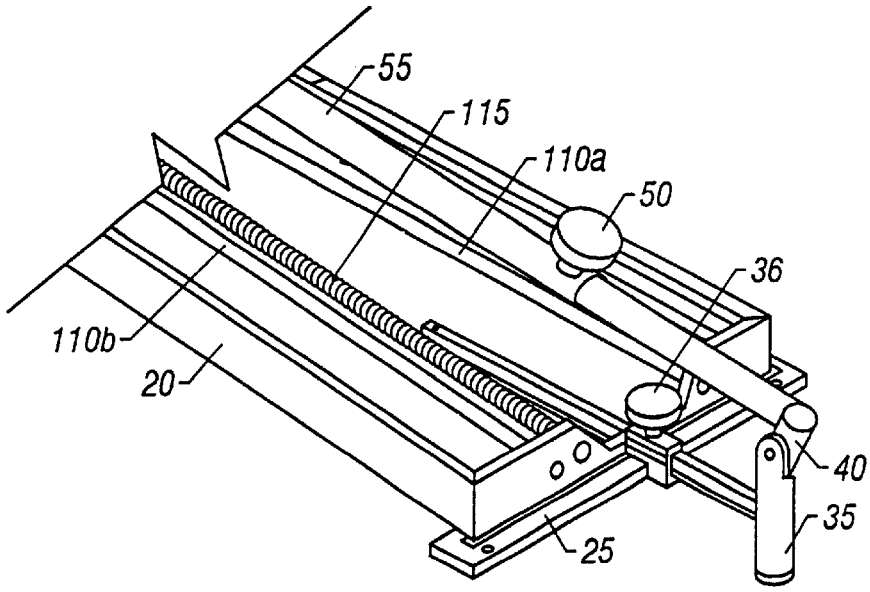
FIG. 2 is a perspective projection of the proximal end of the CPM device according to this invention, which shows the jointed attachment element in its middle position for transportation and storage.

Therefore, the CPM device can be set for use with a left limb or a right limb, or for storage and transportation by immobilizing the attachment element 35 in the appropriate position with the set screw 36. The immobilization of the attachment element 35 in the middle of the slider 37, as shown in FIG. 2, makes it possible to fold the CPM device into a unit that has smaller dimensions.

The supporting element 30 consists of a jointed structure that comprises upper and lower elements supporting the limb. Actually, the jointed structure consists mainly of a crural segment or cradle 31 and a tibial segment or cradle 32, which are arranged in prolongation of one another and linked about an axis x–x' that is transverse to the overall path of the jointed structure.

The crural segment 31 consists of two proximal bars 65*a* and 65*b*, linked by a brace 85 that is itself fitted with a comfort hammock to support the thigh of the lower limb to be rehabilitated. The bars 65*a* and 65*b* are tubular and provided with locking buttons 60*a* and 60*b* that make it possible to link either of said bars to an extension 55, which is itself attached to the element 35 through a pivot 40. The extension 55 is preferably telescopic and its length can be adjusted through an adjusting mechanism 50.

The tibial segment 32 consists of two bars 90*a* and 90*b* connected by a brace, not shown in the drawing, which allows for the mounting of a comfort hammock to support the leg of the limb to be rehabilitated. The bars 90*a* and 90*b* have a footrest 100 on their distal end, which is preferably attached in a removable manner and can be adjusted with buttons 75*a* and 75*b*. The bars 90*a* and 90*b* are linked to the bars 65*a* and 65*b* through pivots 80*a* and 80*b* that constitute the axis x–x'.

According to the invention, the bars 90*a* and 90*b* are provided with extensions 130*a* and 130*b* which extend towards the base and are fitted with sockets, rings or similar devices 72*a* and 82*b*, which are capable of sliding over the supporting bars 70*a* and 70*b* of which the proximal ends are linked to bars 65*a* and 65*b* through pivots 82*a* and 82*b*, which are located between the axis x–x' and the proximal ends of said bars. The distal ends of the supporting bars 70*a* and 70*b* are mounted through pivots 120*a* and 120*b* over a driving element 125, such as a carriage, which is part of a driving mechanism supported by the base 20. This mechanism comprises a screw 115 that is mounted on the base 20 and combines with the carriage and two guides 110*a* and 110*b*, which are also mounted on the base 20, to support and guide the carriage. The screw 115 is linked through a flexible coupling to a back-geared motor 105 that is preferably supported by the distal end 21 of the base 20.

The rotary motion of the screw 115 generated by the motor leads to the linear displacement of the driving carriage 125 along the guides 110*a* and 110*b*, which produces, through supporting bars 70*a* and 70*b*, the bending-stretching motion of the jointed structure 30 which, in turn, imposes said motion on the limb that it is supporting through segments 31 and 32. It should be noted that the mounting of the tibial segment over the supporting bars 70 produces, for each bar 90, some type of collapsible quadrilateral that comprises a sliding point constituted by the corresponding socket 72. Such mounting introduces a multiplying effect in the motion, which makes it possible to obtain the bending-stretching motion of the jointed structure 30, by providing a limited travel of the carriage 125. Therefore, such arrangement allows for reduced spatial requirements, in particular for the base 20. Such arrangement also makes it possible to implement a motor 105 of reduced output, which further reduces the spatial requirements, as well as the weight of the device.

Figure 3:
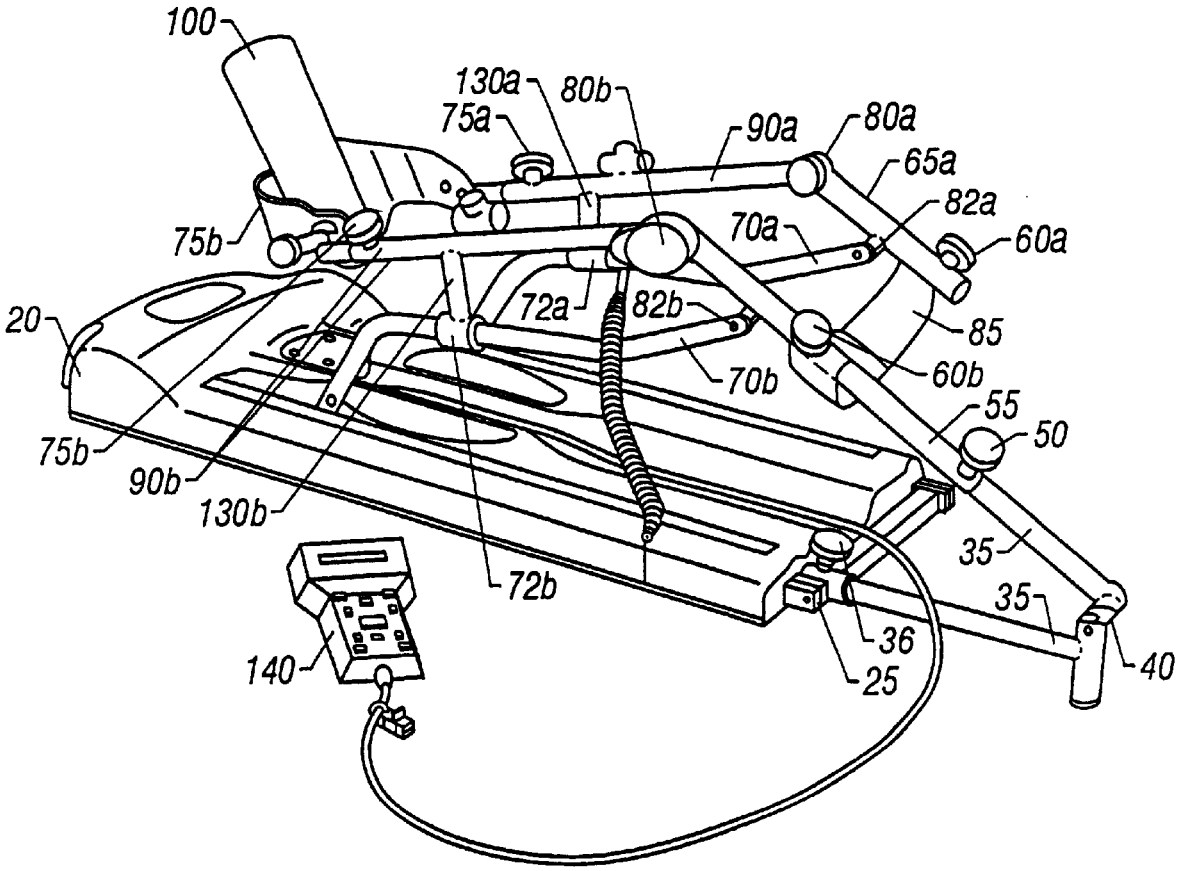
FIG. 3 represents the general outlay of the CPM device according to this invention

An electronic control box 140 (FIG. 3) is used to preset the stretching limit, the bending limit and the motion speed. A "reproducing" potentiometer installed on pivot 80*b* closes the control circuit.

Another advantage of the construction of the device results from the mounting of the crural segment over the base 20, through an extension 55. This allows for the use of the shorter bars 65*a* and 65*b*, which offer a greater adaptability when the device must be used on short femurs. Furthermore, the lateral adjustability of the linkage to the right or to the left through the element 35 makes it possible to eliminate any functional interference between the base 20 and the thigh of the patient, regardless of whether the limb to be immobilized is to the right or to the left, as the element 35 can be equally attached to the right or to the left.

It should also be noted that the extension 55 is telescopic and adjustable, which allows for the accurate adjustment of the length of the crural segment between the axis x–x' and the pivot 40 and, therefore, makes it possible to adapt at least one such adjustment in order to match said pivot with the coxofemoral or acetabular joint of a lower limb to be rehabilitated.

Preferably, the attachment element 35 is permanently attached to the base. When the device must be used for a left limb instead of a right limb, the extension bar 55 is separated from the proximal bar 65*a*, the attachment element 35 is loosened to allow the device to slide over the slider 37, and the device is reattached on the left side. This adaptability is especially useful if the CPM device is installed in a patient.

Another advantage of the device is due to the fact that the proximal bars and the lower bars supporting the limb can be deployed telescopically, thus offering a wide range of atypical settings for patients ranging in size between 112 cm and 206 cm.

List of References

CPM device 10
Base 20
Distal end of base 21
Proximal end of base 25
Jointed structure 30
Crural segment 31
Tibial segment 32
Adjusting buttons 36, 50, 60*a*, 60*b*, 75*a*, 75*b*
Extension bar 55
Crural segment bars 65*a* , 65*b*
Upper cradle for limb 85
Pivots 40, 80*a*, 80*b*, 82, 82*b*, 120*a*, 120*b*
Supporting bars 70*a*, 70*b*
Sliding point links 72*a*, 72*b*
Bars of tibial segment 90*a*, 90*b*
Footrest 100
Back-geared motor 105
Guides 110*a*, 110*b*
Screw 115
Driving element 125
Extension 130*a*, 130*b*
Electronic control box 140

This invention can be particularly beneficial if it is applied in the construction of mobilization splints intended for in-home rehabilitation purposes.

What is claimed is:

1. A device for producing a continuous passive motion machine for the bending and stretching of the jointed limb of a person, according to a predetermined motion cycle, the device comprising:

a driving element capable of moving to-and-fro along a linear path defined as a base element;

an upper and lower element supporting a jointed limb, linked for pivoting about an axis x—x that is substantially transverse relative to said path;

a linking element connecting said upper element to said driving element;

wherein said linking element is mounted so as to pivot in r elation to both said upper support element and said driving element about axes that extend substantially transverse relative to said path, and said lower element supporting the limb being adapted to be retained in sliding engagement against said linking element.

2. The device of claim 1, wherein the linking element is connected to the upper element supporting the limb and enabling it to pivot on a transverse axis located between the two pivoting axis and including an adjustable attachment element connecting said upper element to the base.

3. The device of claim 1, wherein the base element supporting a jointed assembly consists of an upper limb supporting element and a lower limb supporting element, which are linked together according to a transverse axis, the improvement comprising:

the upper element being connected to the base element in a removable manner by a side bar or extension, said side bar or extension being linked to an adjustable attachment element through a pivot.

4. The device of claim 3, wherein the bar or extension is linked to the jointed attachment element, said attachment element being supported by a set screw over a transverse slider that is part of said base.

5. The device of claim 4, wherein the set screw can be adjusted crosswise over the slider, said slider being supported by a proximal part of the base.

6. The device of claim 3, wherein the bar or extension can be adapted to a left side or a right side of the upper element supporting the limb.

7. The device of claim 3, wherein the bar is telscopic.

* * * * *